United States Patent [19]

Sakurai et al.

[11] 4,063,247

[45] Dec. 13, 1977

[54] HEATER GLASS SHEET WITH BROAD BAND RECEIVER ANTENNAE

[75] Inventors: Kaoru Sakurai, Kawasaki; Harunori Murakami; Mitsuhiro Nakamura, both of Yokohama; Toshinobu Kuroyama, Kasugai, all of Japan

[73] Assignees: Nippon Sheet Glass Co., Ltd., Osaka; Toyota Jidosha Kogyo Kabushiki Kaisha, both of Japan

[21] Appl. No.: 730,515

[22] Filed: Oct. 7, 1976

[51] Int. Cl.[2] ..... H01Q 1/02

[52] U.S. Cl. ..... 343/704; 343/713; 219/203; 219/522

[58] Field of Search ..... 219/203, 522, 543; 343/704, 711, 713, 729

[56] References Cited

U.S. PATENT DOCUMENTS

| | | | |
|---|---|---|---|
| 3,484,583 | 12/1969 | Shaw, Jr. | 219/522 |
| 3,484,584 | 12/1969 | Shaw, Jr. | 219/522 |
| 3,659,079 | 4/1972 | Whittemore | 219/522 |
| 3,771,159 | 11/1973 | Kawaguchi | 343/729 |
| 3,928,748 | 12/1975 | Sauer | 219/522 |
| 3,964,068 | 6/1976 | Torii et al. | 343/704 |
| 3,971,029 | 7/1976 | Torii et al. | 343/704 |
| 4,003,056 | 1/1977 | Davis | 343/704 |

*Primary Examiner*—Volodymyr Y. Mayewsky
*Attorney, Agent, or Firm*—Wenderoth, Lind & Ponack

[57] ABSTRACT

A glass sheet with broad band receiver antennae and an area to be heated, comprising a glass sheet, a first means provided in the heating area of the glass sheet and capable of functioning both as a heating conductor wire and as a first receiver antennae for receiving waves in predetermined frequency band, an electric source connected to the first means for supplying a heating current to the first means, and a second means provided in an area of the glass sheet other than the heating area and capable of functioning as second receiver antennae for receiving waves in a frequency band different from the frequency band for the first receiver antennae. This glass sheet further includes a stub one end of which is connected to the first means and the other of which to the second means, and a feeder connected to the second means.

17 Claims, 8 Drawing Figures

HEATER GLASS SHEET WITH BROAD BAND RECEIVER ANTENNAE

FIELD OF THE INVENTION

This invention relates to a glass sheet with receiver antennae and an area to be heated, and more specifically, to a heater glass sheet with broad band receiver antennae which is suitable for use as a rear windowpane of an automobile.

DESCRIPTION OF THE PRIOR ART

Glass sheets with receiver antennae and an area to be heated, for use as a rear windowpane of an automobile, have already been known.

For example, U.S. Pat. No. 3,484,584 discloses a heater glass sheet having a receiver antenna for use in a rear windowpane of an automobile, in which a heating conductor wire provided in the glass for heating the glass to prevent fog formation thereon is utilized also as the receiver antenna. When the conductor wire in this glass sheet receives waves having a radio frequency, such as waves in a very high frequency region, the radio frequency current induced in the conductor wire flows toward an electric source which is connected thereto for supplying a heating current. Accordingly, this structure has the defect that the gain of the receiver antenna, particularly in a very high frequency band, is considerably low. Usually, in such a heater glass sheet having a receiver antenna, a coil having a low impedance to a heating current (this current is usually a direct current) to be supplied to the conductor wire from the electric source and a high impedance to a high frequency current induced in the conductor wire as a result of receiving waves is provided between the conductor wire and the electric source in order to prevent the current induced in the conductor wire from flowing toward the electric source. The coil acts effectively when the waves to be received are in a medium frequency band. However, when the waves to be received have an exceedingly radio frequency as in the case of very high frequency waves, its impedance is reduced by the influence of the stray capacitance of the coil, and the intended action cannot be performed. Hence, the heating conductor wire can be effectively utilized as a receiver antenna for receiving waves in a medium frequency band, but not as a receiver antenna for receiving waves having a radio frequency as in very high frequency waves because of the low gain.

DT No. 1,958,496 discloses a heater glass sheet having a receiver antenna for use as a rear windowpane of an automobile,which includes a heating conductor wire and a separate conductor wire for receiver antenna.

In this type of glass sheet equipped with a receiver antenna, the conductor wire for heating and the conductor wire as receiving antenna are provided separately from each other, and therefore, the conductor wire as receiver antenna is not connected to an electric source for supplying current for heating. The structure, therefore, does not have the defect that the gain of the receiver antenna is reduced considerably in a very high frequency region owing to the flowing of a very high frequency current induced in the conductor wire as receiver antenna toward the electric source. However, since the conductor wire as receiver antenna is provided separately from the heating conductor wire, the area in which to provide the antenna conductor wire is limited to the one other than the area in which to provide the heating conductor wire (i.e., the area to be heated), and therefore, it is impossible to provide a conductor wire having a long effective length for a receiver antennae. As a result, there can only be obtained a receiver antenna having a considerably low gain in a medium frequency band.

In order to avoid the defects of the two known types of heater glass sheets equipped with a receiver antenna described hereinabove, attempts have been made to utilize the heating conductor wire as a receiver antenna for waves in a medium frequency band, and separately provide a conductor wire which constitutes a receiver antenna for waves in a very high frequency band. This structure still poses problems. For example, when the two receiver antennae are connected in parallel to a feeder, one receiver antenna has a considerably reduced gain by the influence of the other. Or it is impossible to match the receiver antennae with the feeder. This leads to the necessity of providing a feeder for each of the receiving antennae, and connecting each of the receiving antennae separately to a receiver. Consequently, the provision of feeders and the connecting of the feeders to the receiver antennae add to the labor and cost, and the antenna terminals of the receiver become complicated.

SUMMARY OF THE INVENTION

It is a primary object of the invention therefore to provide a novel and excellent glass sheet with receiver antennae and an area to be heated, which is free from the defects of the prior art and includes receiver antennae having a high gain over a broad frequency band.

Another object of this invention is to provide a glass sheet having an area to be heated, especially suited as a rear windowpane of an automobile, which include a first receiver antenna for waves of a predetermined frequency band and a second receiver antenna for waves of a different frequency band from the frequency band for the first antenna, both of which antennae are connected to a receiver through a single feeder.

Still another object of this invention is to provide a glass sheet having an area to be heated, especially suited as a rear windowpane of an automobile, which includes a first receiver antenna for receiving waves in a medium frequency band which also functions as a heating conductor wire, and a second receiver antenna for receiving waves in a very high frequency band.

According to the present invention, there is provided a glass sheet having an area to be heated and broad band receiver antennae, comprising in combination:

1. a glass sheet,
2. a first means provided in the heating area of said glass sheet and capable of functioning both as a heating conductor wire and as a first receiver antenna for receiving electromagnetic waves in a predetermined frequency band,
3. an electric source connected to the first means for supplying a heating current to the first means,
4. a second means provided in an area on the glass sheet other than the heating area and capable of functioning as a second receiver antenna for receiving electromagnetic waves in a higher frequency band than the frequency band for the first receiver antenna,
5. a stub having one end connected to the first means and the other end to the second means, and
6. a feeder connected to the second means.

In the glass sheet of the above structure, the stub connected between the first and second means shows a relatively high impedance against the current induced in the second means by the waves of higher frequency which the second receiving antenna has received, thus isolating the first antenna from the second. This effectively prevents the reduced gain of the second antenna which may be caused by the flowing of the current induced in the second means toward the first means and the electric source, and the second antenna exhibits a high gain substantially equivalent to the case of using it alone without being connected to the first antenna. On the other hand, the stub acts merely as a transmission path for the current induced in the first means by the low frequency waves received by the first antenna. Hence, the low frequency current so induced in the first means flows in good condition via the stub in a lead conductor wire connected to the second means without being adversely affected by the second antenna to any appreciable degree. Consequently, the first antenna also shows a high gain substantially equivalent to the case of using it alone without being connected to the second antenna. In this way, the heater glass sheet of this invention has a receiving antenna system showing a high gain over a broad frequency band which is composed of the first and second receiver antenna each having a high gain in the respective receiving frequency bands and capable of being connected to a receiver through a single feeder.

Furthermore, in the glass sheet of this invention, the impedance on the side of the receiver antenna system, as seen from the point of connection between the receiving antenna system and the feeder (i. e., the feeding point), can be easily controlled by adjusting the length of the stub connected between the first and second means, for example. Hence, the receiver antenna system can be easily matched with the feeder.

In a preferred embodiment of the invention, the first and second means are so designed that the first antenna receives waves of AM band broadcasts in a medium frequency band, and the second antenna, FM broadcasts in a very high frequency band.

The above and other objects and advantages of this invention will be more clearly understood from the following description directed to preferred embodiments of the invention taken in conjunction with the accompanying drawings.

DETAILED DESCRIPTION OF PREFERRED EMBODIMENTS

Figure 1:
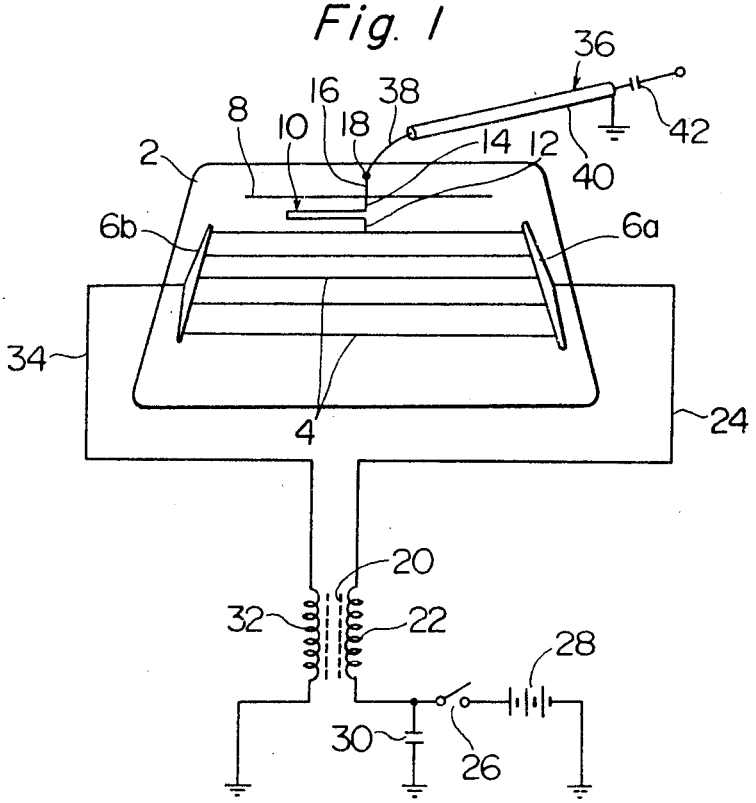
FIG. 1 is a simplified view of a preferred embodiment of the glass sheet having an area to be heated and receiver antennae in accordance with this invention which is constructed as a rear windowpane of an automobile.

Referring to FIG. 1 which shows a preferred embodiment of the glass sheet having an area to be heated and receiver antennae in accordance with this invention which is constructed as a rear windowpane of an automobile, the invention is described more specifically below.

A first means consisting of a plurality (five in the case of the drawing) of conductor wires 4 extending laterally in parallel to one another at intervals is provided in an area to be heated of a transparent or translucent glass sheet 2 that makes up the rear window-pane of an automobile, which area is at the center of the glass sheet 2 in its longitudinal direction (the vertical direction in FIG. 1). The first means functions as a heating conductor wire for heating the glass sheet 2 to prevent the formation of fog thereon, and also as a first receiver antenna for receiving waves of a predetermined frequency band, preferably AM broadcasting waves in a medium frequency band. A pair of bus bars **6*a* and 6*b* are provided on both end portions of the conductor wires 4. These bus bars 6*a* and 6*b* are spaced apart by a suitable distance from the side edges of the glass sheet 2** so that the electrostatic capacity between them and a metal window frame (not shown) of the automobile is sufficiently small.

In that area of the glass sheet 2 which is above the heating area where the conductor wires 4 are provided, a second means which functions as a second receiver antenna and is composed of a conductor wire 8 having a length suitable for receiving radio waves in a higher frequency band than the frequency band for the first receiver antenna, preferably FM broadcast waves in a very high frequency band, is provided. A stub 10 is provided between the conductor wires 4 and the conductor wire 8 which constitutes the second means. The stub 10 is made up of a pair of conductor wires extending parallel to each other at a fixed distance therebetween of which one ends (the left ends in the drawings) are short-circuited from each other. It functions merely as a transmission line for the current induced in the first antenna as a result of its reception of waves of a predetermined frequency band, and on the other hand, shows a relatively high impedance to the current induced in the second antenna as a result of its reception of waves in a higher frequency band, thereby to isolate the conductor wire 8 as the second antenna substantially from the conductor wires 4 as the first antenna. The length of the conductor wires which form the stub and the distance between them are properly selected according to the frequency band for the first receiver antenna and the frequency band for the second antenna. Experiments of the present inventors have shown that when the frequency band for the first receiver antenna is a medium frequency band and the frequency band for the second receiver antenna is a very high frequency band, the distance between the two conductor wires forming the stub 10 is preferably 2 to 50 mm, and the length of each conductor wire (the length of the parallel portion) is preferably 200 to 600 mm.

One end of the stub 10 is connected to the central part of the uppermost conductor wire 4 by means of a connecting wire 12, and the other end, to the central part of the conductor wire 8 by means of a connecting wire 14.

A lead wire 16 extends upwardly from the central part of the conductor wire 8 to a feeding point 18.

The conductor wires 4 forming the first means, the bus bars **6*a* and 6*b*, the conductor wire 8 forming the second means, the connecting wires 12 and 14 and the lead wire 16 can be made by various known methods. For example, they can be produced by printing electroconductive paste prepared from a low-melting glass powder, fine particles of silver, and other optional ingredients using an organic solvent on the glass sheet 2 by a silk-screening process, and baking it. Or when the glass sheet 2** is made of a laminate glass composed of two glass sheets with an interlayer of a synthetic resin, they can be formed by embedding fine metal wires in the synthetic resin interlayer.

The bus bars 6a and 6b are connected to an electric source for heating current in known modes, preferably through a coil which has a low impedance to the heating current supplied from the electric source to the bus bars and a high impedance to the radio frequency current induced in the conductor wires 4 as a result of wave reception. In the specific embodiment illustrated in FIG. 1, the bus bar 6a is connected through a lead wire 24 to one end of a coil 22 (of, say, about 2000 μH) wound on a ferrite magnetic core 20. The other end of the coil 22 is connected through a switch 26 to the positive pole of an electric source 28 (e. g., a battery mounted in an automobile) whose negative pole is grounded. One end of a condenser 30 for preventing noises of electric source with the other end grounded is connected between the other end of the coil 22 and the switch 26. On the other hand, the bus bar 6b is connected by means of a lead wire 34 to one end of a coil 32 (of, say, about 2000 μH) wound on the ferrite magnetic core bifilarly. The other end of the coil 32 is grounded. The lead wires 24 and 34 are spaced by a sufficient distance from the metal body of the automobile so that the stray capacity between them and the ground is sufficiently small.

One end of a feeder 36 is connected to the forward end (i. e., the feeding point 18) of a lead wire 16 extending from the conductor wire 8 constituting the second means. The feeder 36 is a coaxial cable composed of a core wire 38 and a grounded sheath wire 40. The other end of the feeder 36 is connected to the antenna terminal of a receiver (not shown) through a condenser 42.

The operation of the heater glass sheet equipped with receiver antennae having the structure illustrated hereinabove will now be described.

When it is desired to heat the rear windowpane (sheet glass 2) of an automobile to prevent fog formation thereon, the switch 26 is closed either manually, or automatically when the amount of moisture on the glass sheet has exceeded a certain limit. A current is therefore supplied from the electric source 28 to the conductor wires 4 through the coils 22 and 32, and the glass sheet 2 is heated by the heat generation of the conductor wires 4 to prevent fog formation. At this time, the coils 22 and 32 have low impedances to the current flowing through the bus bars 6a and 6b. Hence, the current for heating is supplied very well from the source 28 to the conductor wires 4.

On the other hand, when it is desired to receive waves of a certain frequency band such as waves of AM broadcasting, the conductor wires 4 act as a receiving antenna, and as a result of wave reception, a radio frequency current is induced in the conductor wires 4. The radio frequency current is transmitted to the coaxial cable 36 through the stub 10 which acts as a transmission line. Since the coils 22 and 32 show high impedances to the radio frequency current induced in the conductor wires 4 as a result of wave reception, the induced radio frequency current does not substantially flow toward the electric source. The conductor wire 8 functioning as a second receiver antenna scarcely affects the radio frequency current induced in the conductor wires 4 and flowing in the coaxial cable 36 through the stub 10. Accordingly, the conductor wires 4 act as a first receiver antenna of high gain for waves in a predetermined frequency band, such as waves of AM broadcasting. Experiments of the present inventors show that the conductor wires 4 functioning as the first receiver antenna exhibited substantially the same high gain as in the case of using them alone without the provision of the stub 10 and the conductor wire 8 as a second antenna.

When it is desired to receive waves in a higher frequency band than the frequency band for the first receiver antenna, such as waves of FM broadcasting, the conductor wire 8 functions as a receiver antenna, and as a result of wave reception, a very high frequency current is induced in the conductor wire 8. This high frequency current is transmitted to the coaxial cable 36. Since stub 10 is provided between the conductor wire 8 and the conductor wires 4, a reactance component exists between the conductor wire 8 and the conductor wires 4 with regard to the very high frequency current induced in the conductor wire 8. This results in the isolation of the conductor wire 8 from the conductor wires 4, and effectively prevents the current induced in conductor wire 8 from flowing toward the conductor wires 4, or the conductor wires 4 as the first receiver antenna from adversely affecting the current induced in conductor wire 8. Accordingly, the conductor wire 8 functions as a second receiver antenna of high gain for waves in a higher frequency band than the frequency band for the first receiver antenna, such as waves of FM broadcasting. Experiments of the present inventors led to the confirmation that the conductor wire 8 functioning as the second receiver antenna showed substantially the same high gain as in the case of using it alone without being connected to the conductor wires 4 as the first receiver antenna, and exhibited a high gain of about 6.5 db when its gain obtained in the case of connecting the conductor wires 4 and the conductor wire 8 directly without the provision of the stub 10 is made a standard.

Accordingly, in the heater glass sheet with receiver antennae in accordance with this invention, a receiver antenna system composed of the first and second receiver antennae shows a high gain over a broad frequency range.

Furthermore, in he heater glass sheet of this invention, the impedance on the receiver antenna system side, seen from the feeding point 18, can be easily controlled by adjusting the distance between the conductor wires that form the stub 10, and/or the length of each stub conductor wire, etc. Thus, the receiver antenna system can be easily matched with the feeder.

Some modified embodiments of the embodiment shown in FIG. 1 are given below by reference to FIGS. 2 to 8 in which the same constituent elements as in FIG. 1 are indicated by the same reference numerals as used in FIG. 1.

Figure 2:
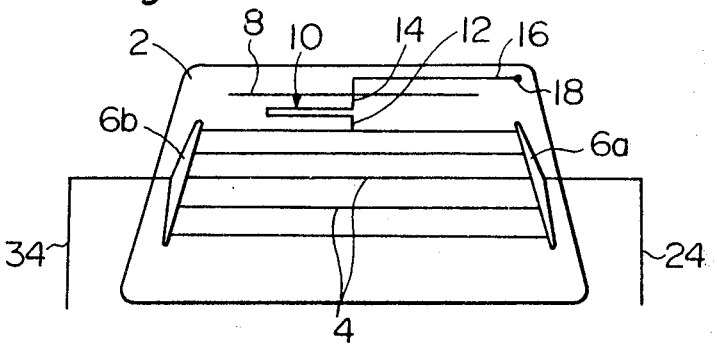
FIGS. 2 to 8 are simplified views, similar to FIG. 1, of modifications of the example shown in FIG. 1.

In the embodiment shown in FIG. 2, the feeding point 18 is brought to a position at a corner near the upper edge of sheet glass 2 (in the drawing, the right side corner) by extending lead wire 16 laterally along the upper edge of sheet glass 2.

The appearance of an automobile may be adversely affected when as in FIG. 1, the feeding point is set at the central part in the lateral direction near the upper edge of the glass sheet 2, and a feeder such as a coaxial cable is connected to it at the central part near the upper edge of the glass sheet 2 in the lateral direction. Especially when the lead wire is composed of a fine metal wire embedded in the synthetic resin interlayer of a laminated glass sheet, it is frequently difficult to connect the lead wire to the feeder. In order to avoid this disadvantage, the lead wire 16 is extended laterally, and the feeding point 18 of the feeder is positioned at the side end of glass sheet 2 in the embodiment shown in FIG. 2.

In this case, it is preferred to provide the lead wire 16 in close proximity to a grounded metal window frame (not shown), for example, while adjusting the distance between the extension of the lead wire 16 and the window frame to less than about 13 mm. This can ensure a marked reduction in transmission losses of the lead wire, and the reduction in the gain of the receiver antenna system caused by extending the lead wire can be removed to a negligible degree.

Figure 3:
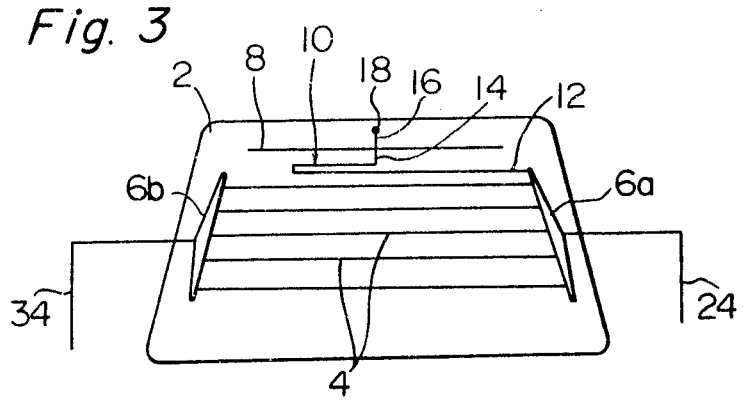

In the embodiment shown in FIG. 3, the mode of connection between one end of stub 10 and the conductor wires 4 differs from that in FIG. 1. In order to connect one end of stub 10 to the conductor wires 4, this end is connected to bus bar 6*a* by means of a connecting wire 12.

Figure 4:
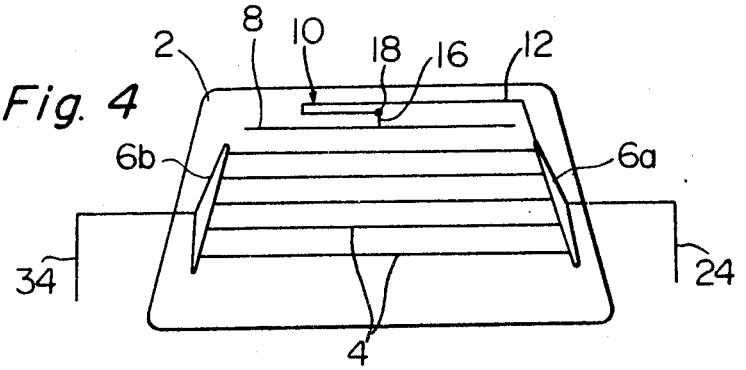

In the embodiment shown in FIG. 4 in which the position of stub 10 on glass sheet 2 and the mode of connection between stub 10 and the conductor wires 4 and 8 are different from those in FIG. 1, the stub 10 is provided above the conductor wire 8, one end of the stub 10 is connected to lead wire 16 extending from the conductor wire 8 (therefore, the connecting wire 14 is omitted), and the other end of the stub 10 is connected to bus bars 6*a* by means of connecting wire 12.

Figure 5:
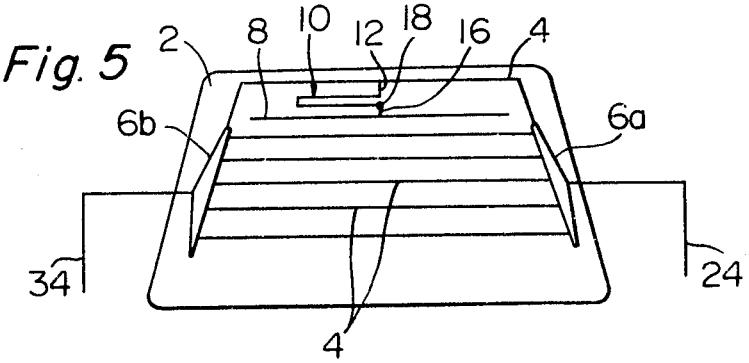
Figure 6:
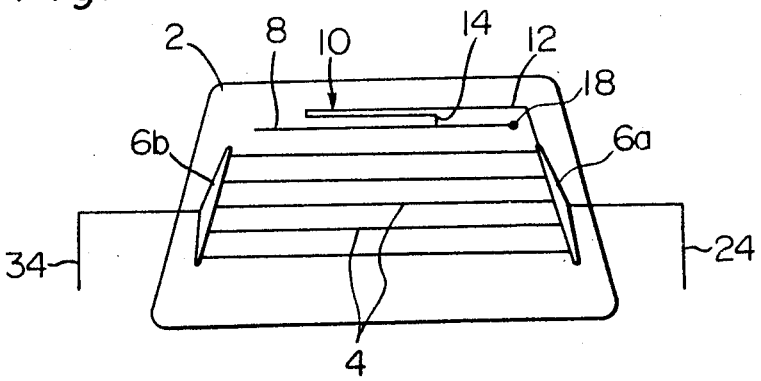

In the embodiment shown in FIG. 5 in which the position of stub 10 on glass sheet 2 and the shape of the conductor wires 4 are different from those in FIG. 1, the stub 10 is provided above the conductor wire 8, and is connected at one end to the lead wire 16 as in the embodiment shown in FIG. 4, and at the other to an additional conductor wire 4 provided above the stub 10.

The embodiment shown in FIG. 5 is a modified form of the embodiment shown in FIG. 4. In this embodimment, one end of the stub 10 is connected by means of connecting wire 14 to that position of the conductor wire 8 which is deviated to the right side, and the other end is connected to bus bar 6*a* by means of conductor wire 12. One end of the conductor wire 8 is made the feeding point 18 (therefore, the lead wire 16 is omitted).

Figure 7:
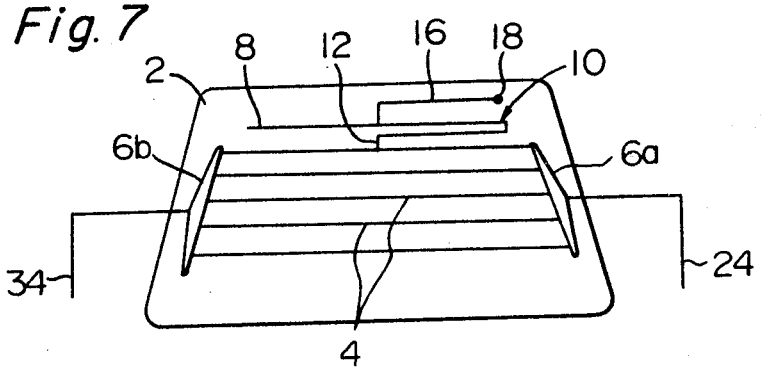

In the embodiment shown in FIG. 7, the relation between the conductor wire 8 and the stub 10 and the lead wire 16 are different from those in FIG. 1. In this embodiment, the conductor wire 8 and the upper conductor wire in the wire pair forming the stub 10 are positioned so as to be continuous to each other and extend substantially in a straight line in the lateral direction (therefor, the connecting conductor line 14 is omitted). Furthermore, the lead wire 16 is caused to extend laterally in the same way as in FIG. 2, and the feeding point 18 is positioned at the side end of glass sheet 2.

Figure 8:
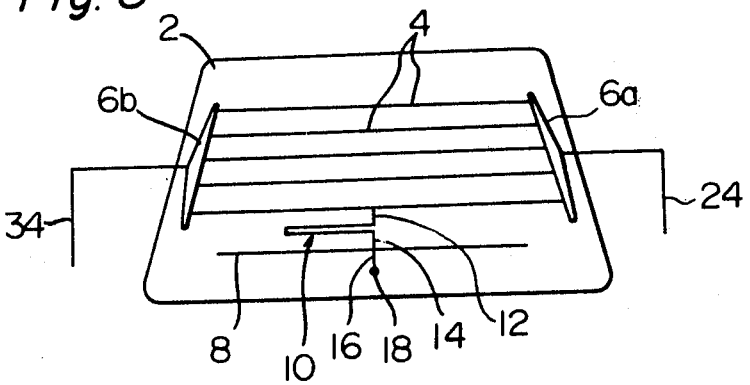

The embodiment of FIG. 8 differs from that of FIG. 1 only in that the conductor wire 8 and the stub 10 are disposed below the conductor wires 4.

While some specific embodiments of the invention have been described hereinabove, it should be understood that the invention is not limited to these specific embodiments, but various modifications and changes are possible without departing from the spirit and scope of the invention. For example, the relative positions on glass sheet 2 of the first means functioning both as a heating conductor and as a first receiver antenna (i. e., the conductor wires 4), the second means functioning as a second receiver antenna (i. e., the conductor wire 8) and the stub 10, the mode of connection between conductor wires 4 and conductor wire 8, or the position of connection between the receiver antenna system and the feeder (i. e., the feeding point) can be varied properly as required.

What we claim is:

1. A glass sheet having an area to be heated, and broad band receiver antennae, comprising in combination:

1. a glass sheet,
2. a first means provided in the heating area of said glass sheet and capable of functioning both as a heating conductor wire and as a first receiver antenna for receiving electromagnetic waves in a predetermined frequency band,
3. an electric source connected to the first means for supplying a heating current to the first means,
4. a second means provided in an area on the glass sheet other than the heating area and capable of functioning as a second receiver antenna for receiving electromagnetic waves in a higher frequency band than the frequency band for the first receiver antenna,
5. a stub having one end connected to the first means and the other end to the second means, and
6. a feeder connected to the second means.

2. The glass sheet of claim 1 wherein the stub is composed of a pair of conductor wires which extend substantially parallel to each other at a predetermined distance therebetween and of which one ends are short-circuited to each other.

3. The glass sheet of claim 1 wherein a lead wire extends from the second means to a corner of the glass sheet so that its main part goes along the edge of the glass sheet, and the feeder is connected to the end of the lead wire.

4. The glass sheet of claim 1 wherein the coil having a low impedance to a heating current to be supplied to the first means from the electric source and a high impedance to a radio frequency current induced in the first means as a result of wave reception is connected between the first means and the electric source.

5. The glass sheet of claim 1 wherein the first means is composed of a plurality of conductor wires which are arranged substantially parallel to each other in the heating area of the glass sheet and of which both ends are connected respectively to bus bars, and the second means is composed of a conductor wire provided in an area on the glass sheet other than the heating area.

6. The glass sheet of claim 5 wherein the stub is composed of a pair of conductor wires which extend substantially parallel to each other at a predetermined distance therebetween and of which one ends are short-circuited to each other, and is connected at one end to the conductor wires forming the first means and at the other to the conductor wire forming the second means.

7. The glass sheet of claim 6 wherein a coil having a low impedance to a heating current to be supplied from the electric source to the first means and a high impedance to a radio frequency current induced in the first means as a result of wave reception is connected between the first means and the electric source.

8. The glass sheet of claim 7 wherein one end of the stub is connected by a connecting wire to the central part of one of the conductor wires forming the first means, and the other end is connected by a connecting wire to the central part of the conductor wire forming the second means.

9. The glass sheet of claim 7 wherein one end of the stub is connected by a connecting wire to the central part of one of the conductor wires forming the first means, and the other end is connected directly to the conductor wire forming the second means so that that wire in the stub wire pair which has the other end is continuous to the conductor wire forming the second means and extends substantially on the same straight line as the conductor wire as the second means.

10. A glass sheet having an area to be heated, and broad band receiver antennae, comprising in combination:

1. a glass sheet,
2. a first means provided in the heating area of said glass sheet and capable of functioning both as a heating conductor wire and as a first receiver antenna for receiving electromagnetic waves of AM broadcasting in a medium frequency band,
3. an electric source connected to the first means for supplying a heating current to the first means,
4. a second means provided in an area on the glass other than the heating area and capable of functioning as a second receiver antenna for receiving electromagnetic waves of FM broadcasting in a very high frequency band,
5. a stub having one end connected to the first means and the other end to the second means, and
6. a feeder connected to the second means.

11. The glass sheet of claim 9 wherein the stub is composed of a pair of conductor wires which extend substantially parallel to each other at a predetermined distance therebetween and of which one ends are short-circuited to each other.

12. The glass sheet of claim 11 wherein the distance between the conductor wires forming the stub is 2 to 50 mm, and the length of each of the conductor wires in the pair is 200 to 600 mm.

13. The glass sheet of claim 10 wherein a lead wire extends from the second means to a corner of the glass sheet so that its main part goes along the edge of the glass sheet, and the feeder is connected to the end of the lead wire.

14. The glass sheet of claim 12 wherein a coil having a low impedance to a heating current to be supplied to the first means from the electric source and a high impedance to a radio frequency current induced in the first means as a result of wave reception is connected between the first means and the electric source.

15. The glass sheet of claim 14 wherein the first means is composed of a plurality of conductor wires which are arranged substantially parallel to each other in the heating area of the glass sheet and of which both ends are connected respectively to bus bars, and the second means is composed of a conductor wire provided in an area on the glass sheet other than the heating area.

16. The glass sheet of claim 15 wherein one end of the stub is connected by a connecting wire to the central part of one of the conductor wires forming the first means, and the other end is connected by a connecting wire to the central part of the conductor wire forming the second means.

17. The glass sheet of claim 14 wherein one end of the stub is connected by a connecting wire to the central part of one of the conductor wires forming the first means, and the other end is connected directy to the conductor wire forming the second means so that that wire in the stub wire pair which has the other end is continuous to the conductor wire forming the second means, and extends substantially on the same straight line as the conductor wire as the second means.

* * * * *